United States Patent [19]

Kobayashi

[11] Patent Number: 4,826,176

[45] Date of Patent: May 2, 1989

[54] ACTION TOY GAME APPARATUS

[75] Inventor: Toshio Kobayashi, Chiba, Japan

[73] Assignee: Ashai Corporation, Tokyo, Japan

[21] Appl. No.: 129,823

[22] Filed: Dec. 7, 1987

[30] Foreign Application Priority Data

Dec. 6, 1986 [JP] Japan ..... 61-188013[U]

[51] Int. Cl.[4] ..... A63B 63/04

[52] U.S. Cl. ..... 273/354; 273/355

[58] Field of Search ..... 273/121 R, 127 R, 354, 273/357, 399, 405

[56] References Cited

U.S. PATENT DOCUMENTS

| | | | |
|---|---|---|---|
| 3,132,864 | 5/1964 | Glass et al. | 273/127 R |
| 3,794,325 | 2/1974 | Stender | 273/399 |
| 4,109,914 | 8/1978 | Matsumoto | 273/354 |
| 4,620,706 | 11/1986 | Ijidakinro | 273/127 R X |

FOREIGN PATENT DOCUMENTS

| | | | |
|---|---|---|---|
| 1568410 | 5/1980 | United Kingdom | 273/354 |

*Primary Examiner*—Robert E. Garrett
*Assistant Examiner*—Joseph M. Pitko
*Attorney, Agent, or Firm*—Salter & Michaelson

[57] ABSTRACT

An action toy game apparatus includes a receiver assembly which is preferably embodied as an amusing character figure, a timer assembly which is actuatable for a set period of time, a plurality of game elements and a propelling mechanism which is operable for individually propelling the game elements at the receiver assembly. The receiver assembly is responsive to the timer assembly for oscillating between a fully open position and a partially open position when the timer assemly is in an actuated condition and for moving to a fully closed position when the timer assembly is deactuated. The game elements are receivable in the receiver assembly when they are propelled at the receiver assembly while the receiver assembly is in either the open position thereof or the partially open position thereof but not while the receiver assembly is in the closed position thereof.

13 Claims, 5 Drawing Sheets

ACTION TOY GAME APPARATUS

BACKGROUND AND SUMMARY OF THE INVENTION

The instant invention relates to amusement games and more particularly to an apparatus for playing an amusement game of the general type wherein a game player must successfully perform certain manipulations within a set time periods of time in order to achieve a game score.

While a wide variety of game devices have been heretofore available for use in playing various amusement games, devices which are operative for playing certain specific types of games have been found to have particular appeal. In particular, devices which are operative for playing games wherein game players must perform certain feats within set periods of time, and devices which are adapted for playing games wherein game players are required to propel game elements at various targets in order to achieve game scores have generally been found to have relatively high levels of appeal. It has also been found that game devices of these types which are effectively adapted for use by children can aid in the development of both hand-to-eye coordination and manual dexterity.

The instant invention provides an effective action toy game apparatus which is adapted for use by children and which is operative for playing an amusement game wherein a game player must successfully and accurately propel game elements at a target within a predetermined period of time in order to achieve a game score. Specifically, the action toy game apparatus of the instant invention comprises a base, a timer on the base which is actuatable for a set period of time, a plurality of game elements, and a receiver assembly on the base which is responsive to the timer and operative for defining a target for receiving game elements therein only during the set period of time as determined by the timer. The apparatus further comprises a manually operable propelling mechanism for individually propelling game elements toward the receiver assembly so that they are receivable therein during the set period of time as determined by the timer. The receiver assembly is adapted so that it remains sufficiently open to individually receive the game elements therein during the set period of time as determined by the timer, but so that it automatically moves to a closed or nonreceiving position wherein the game elements are nonreceivable therein upon the expiration of the set period of time. The receiver assembly preferably comprises a character figure including a lower jaw portion and an upper head portion which cooperate to define a mouth of the character figure. The lower jaw portion is preferably constructed so that it normally remains substantially stationary during operation of the apparatus, and the upper head portion is preferably adapted so that it is rearwardly pivotable to move the mouth of the character figure between a fully open position, a partially open position, and a closed position. Further, the character figure is preferably adapted so that the game elements can be individually received in the mouth thereof when the mouth is in either the open position or the partially open position but so that the game elements cannot be received in the mouth when the receiver assembly is in the closed position. Still further, the receiver assembly preferably communicates with the timer for oscillating the mouth of the character figure between the open position and the partially open position during the set period of time as determined by the timer. In this connection, the timer preferably comprises a cam wheel having a pair of eccentric elements therein, and the character figure preferably includes a lever arm which communicates with the eccentric elements for pivoting the upper head portion of the character figure rearwardly to move the mouth between the open, the partially open, and the closed positions thereof. The game elements of the game apparatus preferably comprise substantially spherical ball elements, and the propelling mechanism preferably includes a manually depressible resilient arm which is releasable for propelling the game elements toward the mouth of the character figure. Further, the resilient arm of the propelling mechanism is preferably adjustable to aim the game elements at the character figure so that they are receivable in the mouth thereof during the set periods of time as determined by the timer.

Accordingly, for use and operation of the game apparatus of the instant invention, the timer is actuated for a set period of time during which the timer operates to move the mouth of the character figure so that it oscillates between the open position thereof and the partially open position thereof. The propelling mechanism is operable for propelling the game elements toward the character figure, and it is adjustable for aiming the game elements so that they are receivable in the mouth of the character figure. In this connection, the game elements are receivable in the mouth of the character figure during the set period of time regardless of whether the mouth is in the fully open position thereof, the partially open position thereof, or an intermediate position therebetween, although the mouth of the character figure obviously provides a larger target when it is in the fully open position. However, the mouth of the character figure is automatically moved to the closed position thereof upon the expiration of the set period of time so that the game elements can no longer be received in the mouth. Accordingly, the ability of a game player to achieve a game score is dependent on the ability of the game player to rapidly aim and operate the propelling mechanism so that the game elements are propelled toward the mouth of the character figure and to time the operation of the propelling mechanism so that the game elements are propelled at the mouth of the character figure when the mouth is in the fully open position thereof.

Hence, it is a primary object of the instant invention to provide an effective amusement game apparatus wherein game elements are propelled at a target during a set period of time.

Another object of the instant invention is to provide a game apparatus for playing a game wherein game elements are propelled at a character figure and wherein the game elements are receivable in the mouth of the character figure only during a set period of time.

An even further object of the instant invention is to provide a game apparatus for playing a game wherein game elements are propelled at the mouth of a character figure during a set period of time as the mouth of the character figure oscillates between a fully open position and a partially open position.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
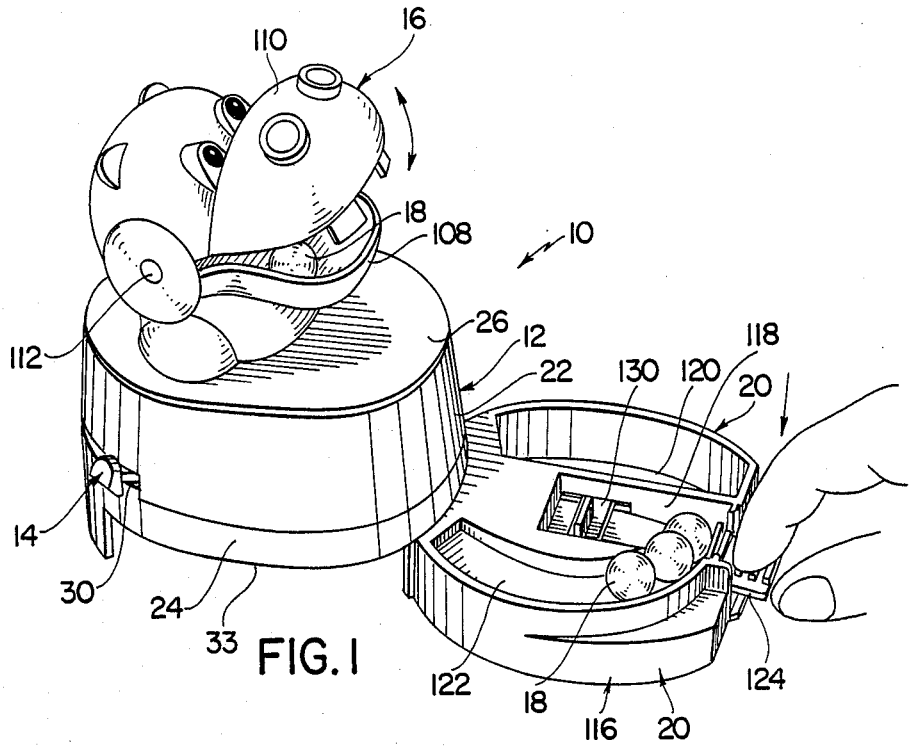
FIG. 1 is a perspective view of the toy game apparatus of the instant invention with the resilient arm in a depressed position.
Figure 2:
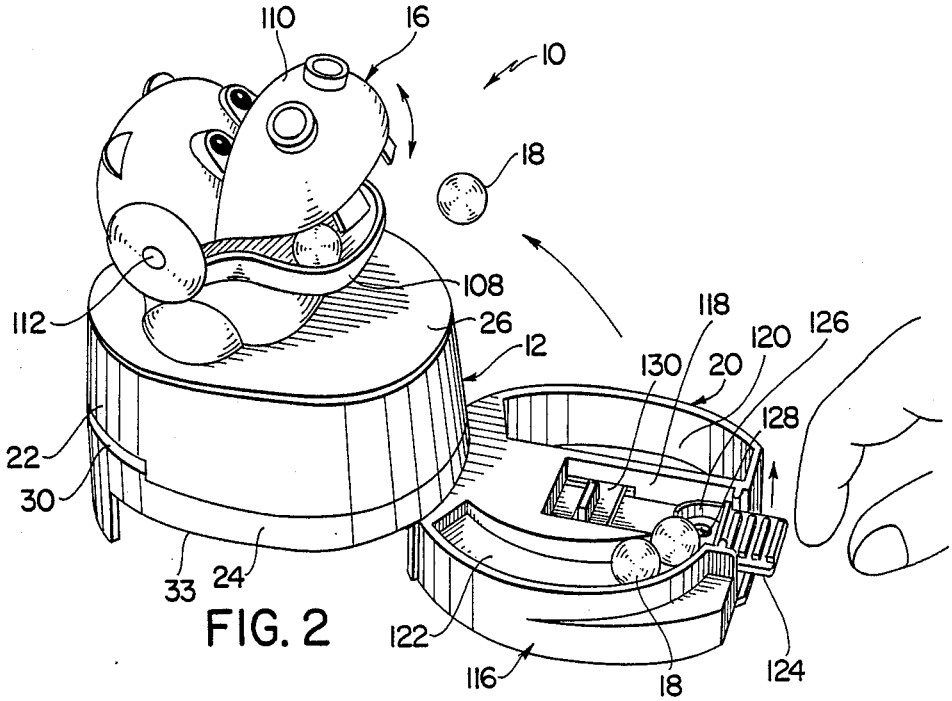
FIG. 2 is a similar view immediately after releasing the resilient arm to propel a game element.
Figure 3:
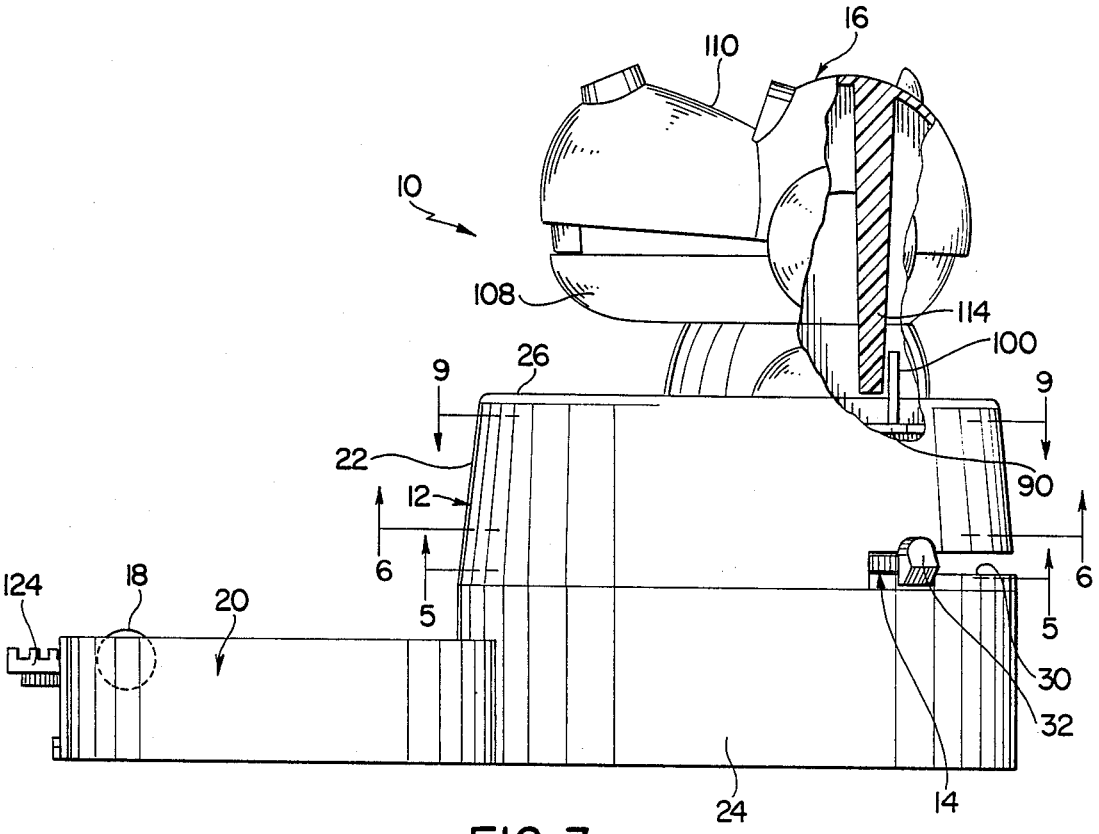
FIG. 3 is a side elevational view of the game apparatus.

Referring now to the drawings, the toy game apparatus of the instant invention is illustrated and generally indicated at 10 in FIGS. 1 through 3. The game apparatus 10 comprises a base generally indicated at 12, a timer assembly generally indicated at 14 and mounted in the base 12, a receiver assembly 16 on the base 12, a plurality of game elements 18, and a propelling mechanism generally indicated at 20. The timer assembly 14 is actuatable for set periods of time, and the receiver assembly 16 communicates with the timer assembly 14 so that it oscillates between a fully open position and a partially open position whenever the timer assembly is actuated but so that it automatically moves to a closed position when the timer assembly is deactuated. The receiver assembly 16 is constructed so that the game elements 18 are receivable therein when the receiver assembly 16 is in either the open position thereof or the partially open position thereof but so that the game elements 18 cannot be received in the receiver assembly 16 when it is in the closed position thereof. The propelling mechanism 20 is operative for propelling the game elements 18 toward the receiver assembly 16 so that they are receivable in the receiver assembly 16 as long as the receiver assembly 16 is in either the open position thereof or the partially open position thereof. Accordingly, the apparatus 10 is operative by actuating the timer assembly 14 for a set period of time and then manipulating the propelling mechanism 20 to individually propel the game elements 18 at the receiver assembly 16 in an attempt to pass as many of the game elements 18 as possible into the receiver assembly 16 during the set period of time.

The housing 12 is preferably made from a suitable plastic material, and it includes upper and lower housing sections 22 and 24, respectively, which cooperate to define both a supporting structure for the receiver assembly 16 and an enclosure for the timer 14. The upper housing section 22 includes an upper wall 26 on which the receiver assembly 16 is mounted, and the lower housing section 24 includes an upper wall 28 illustrated in FIGS. 9 through 11. The upper and lower housing sections 22 and 24 cooperate to define an elongated slot 30 through which a winding arm 32 of the timer assembly 14 projects, and an enlarged open notch 33 is formed in the lower housing section 24 for accommodating the propelling mechanism 20 in a manner which will hereinafter be more fully set forth. An enlarged pin 34 extends integrally downwardly from the upper wall 28 of the lower housing section 22 for pivotably mounting the propelling mechanism 20 in a manner which will also hereinafter be more fully set forth.

The timer assembly 14 is illustrated most clearly in FIGS. 4 through 6 and 9 through 11. The timer assembly 14 is mounted on the underside of the top wall 26, and it includes a casing 35 comprising a lower casing section 36, an upper casing section 38 and an intermediate partition 40 (illustrated in FIGS. 4 and 5) which separates the lower and upper casing sections 36 and 38, respectively. The timer assembly further comprises a winding mechanism illustrated most clearly in FIGS. 4 and 5 and generally indicated at 42, a decay mechanism illustrated most clearly in FIG. 6 and generally indicated at 44, and a camming mechanism illustrated most clearly in FIGS. 9 through 11 and generally indicated at 46.

Figure 4:
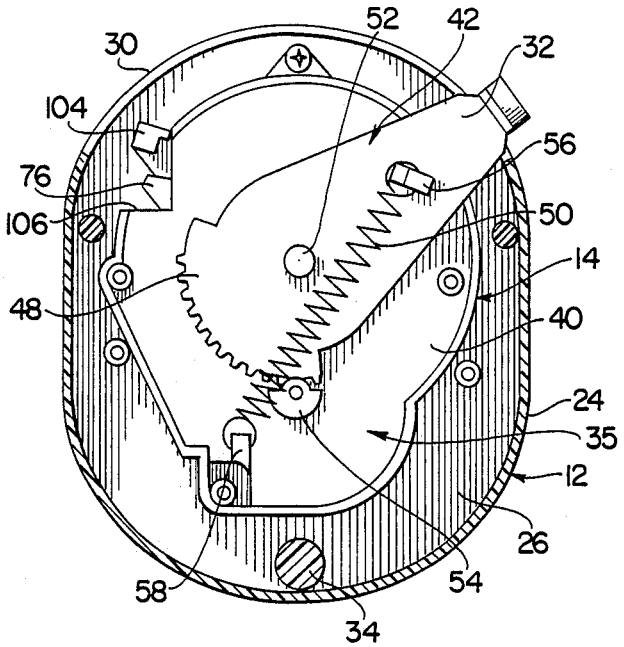
FIG. 4 is a sectional view of the game apparatus illustrating the timer assembly in an actuated position.
Figure 5:
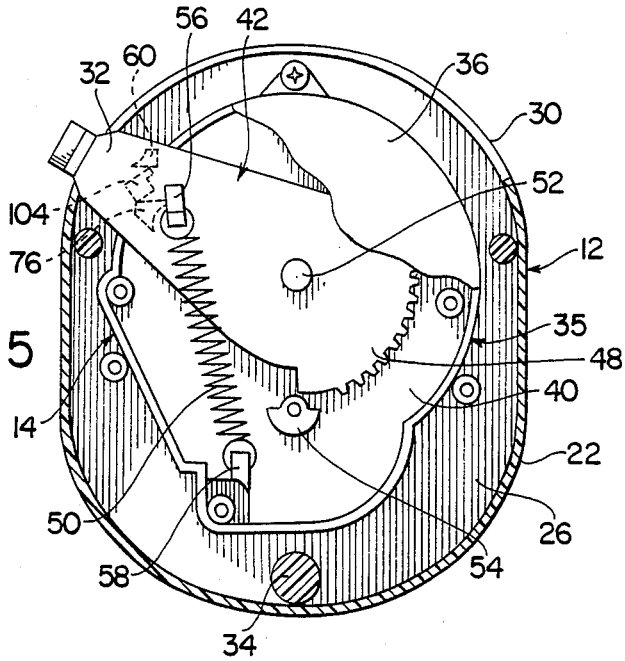
FIG. 5 is a similar sectional view taken along line 5—5 in FIG. 3 with the timer assembly in an unactuated position.
Figure 7:
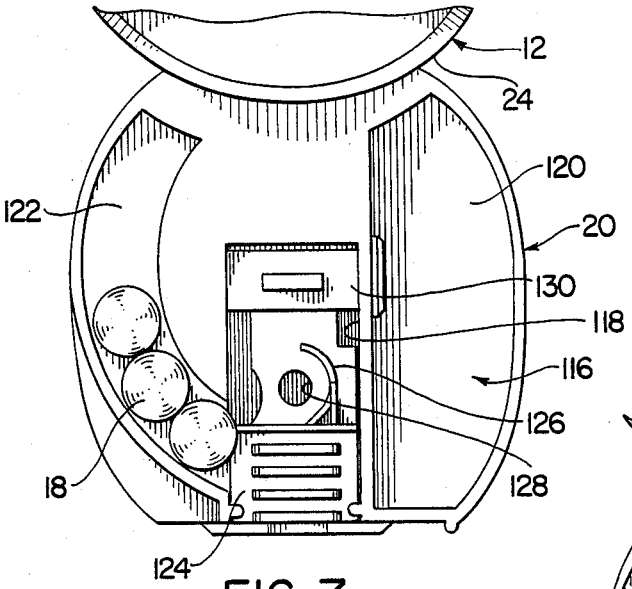
FIGS. 7 and 8 are elevational views illustrating the operation of the propelling mechanism.
Figure 8:
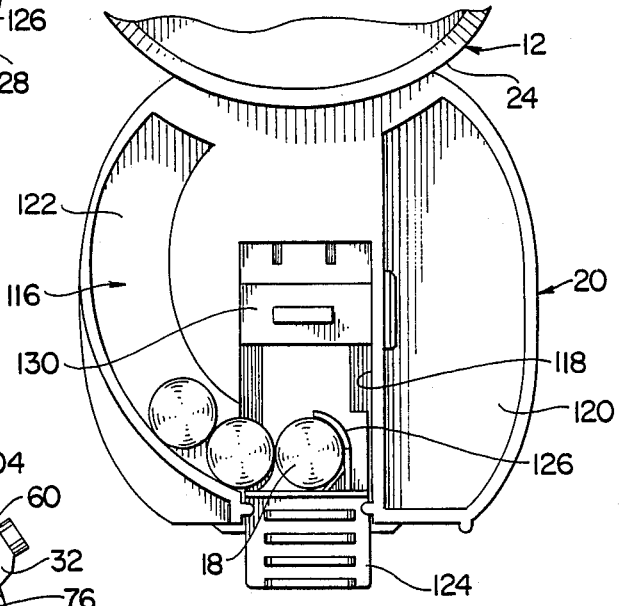

Referring to FIGS. 4 and 5, the winding mechanism 42 is more clearly illustrated. The winding mechanism 42 includes the winding arm 32 which is integrally formed with a fan gear 48, and a coil spring 50. The winding arm 32 is preferably integrally molded from a suitable plastic material in a substantially flat configuration, and it is pivotably mounted on a pin 52 which extends downwardly from the partition 40. The winding arm 32 is mounted so that as it travels in the slot 30, the fan gear 48 passes through an open gear housing 54 which is also integrally molded on the underside of the partition 40. Lugs 56 and 58 are formed on the underside of the winding arm 32 and on the underside of the partition 40, respectively, as illustrated, and the spring 50 is secured to the lugs 56 and 58 for biasing the winding arm 32 to an unwound position. In this connection, the winding arm 32 is operative between the wound position thereof illustrated in FIG. 4 and the unwound position thereof illustrated in FIG. 5, and the fan gear 48 of the winding mechanism 42 communicates with the decay mechanism 44 as the fan gear 48 passes through the housing 54 as will hereinafter be more fully set forth. As a result, the spring 50 is operative for driving the decay mechanism 44 by biasing the winding arm 32 to the unwound position thereof. A disengagement lug 60 is formed on the upper side of the winding arm 32 for reasons which will hereinafter be set forth.

Figure 6:
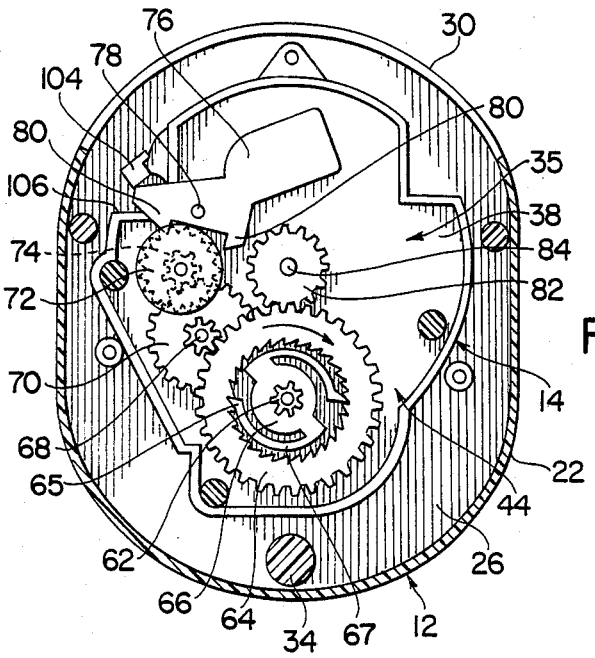
FIG. 6 is a sectional view taken along line 6—6 in FIG. 3.

The decay mechanism 44 is illustrated more clearly in FIG. 6. The decay mechanism 44 is mounted in the upper casing section 38, and it comprises a reduced main drive gear 62 which is received in the housing 54 so that it communicates with the fan gear 48 and an enlarged main transmission gear 64 which is concentrically oriented with respect to the main drive gear 62. The enlarged main transmission gear 64 is formed with a substantially circular central open area therein, and it is further formed with interior ratchet teeth 65 which extend into the central open area therein. A ratchet ring 66 having a pair of resilient ratchet arms 67 is concentrically mounted on a common shaft with the main gear 62 so that the ratchet arms 67 communicate with the ratchet teeth 65. Accordingly, the main drive gear 62 is operative for driving the transmission gear 64 in the direction indicated; but when the main drive gear 62 is rotated in the reverse direction, the ratchet arms 67 pass over the teeth 65 on the transmission gear 64 to allow the main drive gear 62 to be rotated relative to the transmission gear 64. As a result, when the fan gear 48 rotates the main drive gear 62 as it is driven by the spring 50, rotation is positively communicated to the transmission gear 64 through the ratchet arms 67; but when the fan gear 48 rotates the main drive gear 62 in a reverse direction as the winding arm 32 is moved to wind the timer 14, the main drive gear 62 is effectively disengaged from the transmission gear 64. The decay mechanism 44 further comprises first and second intermediate transmission gears 68 and 70 and an escapement wheel 72 having a reduced escapement wheel gear 74 thereon. The intermediate transmission gears 68 and 70 intermesh with the main transmission gear 64 and the reduced escapement wheel gear 74, respectively, in order to communicate rotation from the main transmission gear 64 to the escapement wheel 72. The escapement wheel 72 is formed with a plurality of pointed or V-shaped teeth thereon, and the decay mechanism 44 further comprises an escapement arm 76 which is pivotably mounted on a pin 78 and includes a pair of jaws 80. The jaws 80 are engageable with the V-shaped teeth of the escapement wheel 72 for oscillating the arm 76 back and forth as the jaws 80 pass from tooth to tooth on the escapement wheel 72 in order to produce a ticking sound from the timer assembly 14. This also provides a controlled decay in the timer assembly 14 so that the spring 50 is unwound at a reduced rate. The decay mechanism 44 further comprises a cam drive gear 82 which also intermeshes with the main transmission gear 64 and is mounted on a shaft 84 which extends through the upper wall of the upper casing section 38 for communicating with the cam mechanism 46. Accordingly, during operation of the decay mechanism 44, the main drive gear 62 is rotated in order to rotate the main transmission gear 64, and the main transmission gear 64 rotates the gears 68, 70 and 74 and the escapement wheel 72 in order to oscillate the escapement arm 76 to provide a controlled decay, and it rotates the cam gear 82 in order to rotate the shaft 84.

Figure 9:
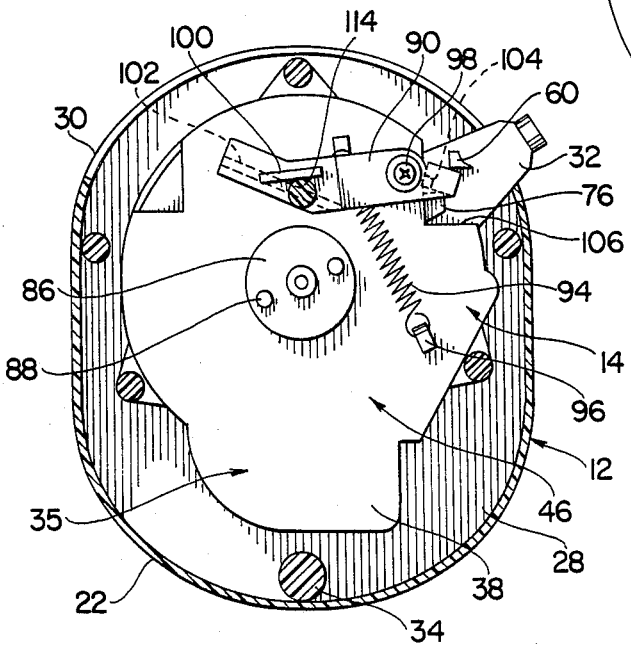
FIG. 9 is a sectional view taken along line 9—9 in FIG. 3.
Figure 10:
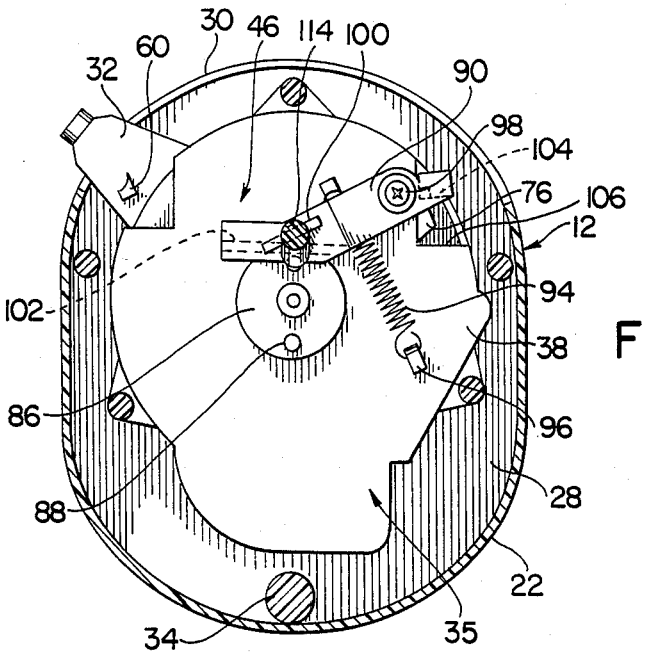
FIGS. 10 and 11 are similar sectional views illustrating the operation of the timer assembly for oscillating the upper head portion of the character figure.
Figure 11:
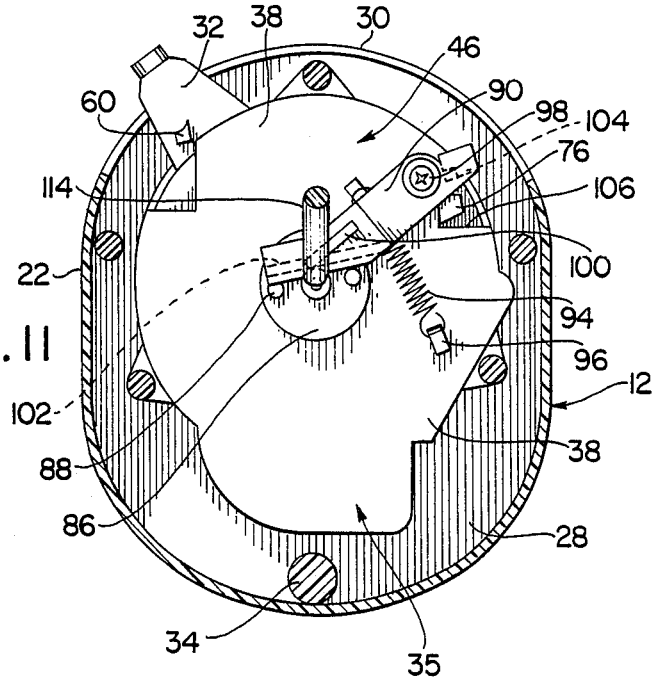

The cam mechanism 46 is illustrated more clearly in FIGS. 9 through 11. The cam mechanism 46 includes a cam wheel 86 having a pair of eccentric cam elements 88 thereon, and it is mounted on the upper side of the upper casing section 38 on the shaft 84. The cam mechanism 46 further comprises a cam arm 90 having a lug 92 thereon, and a spring 94 which extends between the lug 92 and a lug 96 which is formed on the upper casing section 38. The cam arm 90 is secured to a post (not shown) with a screw 98 for pivoting it about the axis of the screw 98, and it further includes both an upwardly extending blade 100 and a downwardly extending blade 102. The spring 94 biases the cam arm 90 to a position wherein the downwardly extending blade 102 communicates with the eccentric elements 88 on the cam wheel 86 so that the cam arm 90 oscillates back and forth as the cam wheel 86 is rotated. The cam arm 90 further includes a leg 104 which extends downwardly through a notch 106 in the upper casing section 38. The leg 104 is positioned so that when the winding arm 32 reaches the fully unwound position thereof illustrated in FIGS. 5 and 9, the disengagement lug 60 on the upper side of the winding arm 32 engages the leg 104 to swing the cam arm 90 outwardly away from the cam wheel 86 as illustrated in FIG. 9. Further, the leg 104 is adapted so that when the disengagement lug 60 engages the leg 104 in this manner, the leg 104 engages the escapement arm 76 to prevent further movement of the escapement arm 76.

Accordingly, during operation of the spring assembly 14, the winding arm 32 is moved to a wound position to load the spring 50, and thereafter the fan gear 48 rotates the main drive gear 62 to effect rotation of the escapement wheel 72 and the cam wheel 86. As the escapement wheel 72 is rotated, the escapement arm 76 oscillates back and forth to control the rate at which the timer assembly 14 is unwound, and as the cam wheel 86 is rotated, the cam arm 90 oscillates back and forth on the upper side of the upper casing section 38. However, when the winding arm 32 reaches the unwound position thereof, the fan gear 48 is disengaged from the main gear 62, and the disengagement lug 60 engages the leg 104 to swing the cam arm 90 away from the cam wheel 86. When this occurs, the leg 104 engages the escapement arm 76 to prevent further movement of the escapement arm 76 even though the decay mechanism 44 is actually disengaged from the fan gear 48 when the winding arm 32 is in the unwound position thereof.

The receiver assembly 16 is preferably formed in the configuration of an amusing character, such as the hippopotamus character illustrated in FIGS. 1 through 3, and it comprises a lower jaw portion 108 and an upper head portion 110. The lower jaw portion 108 is secured in a fixed position on the upper housing section 26, whereas the upper head portion 110 is pivotably connected to the lower jaw portion 108 about an axis 112 so that the upper head portion 110 is upwardly and rearwardly pivotable for opening the mouth of the character figure embodied in the receiver assembly 16. The receiver assembly 16 is further formed so that the mouth of the character figure can accommodate a plurality of the game elements 18 therein. The receiver assembly 16 further comprises an elongated lever arm pin 114 (see FIGS. 3 and 9 through 11) which extends downwardly from the upper head portion 110 so that it communicates with the upwardly extending blade 100 on the cam arm 90. Accordingly, as illustrated in FIGS. 10 and 11, as the downwardly extending blade 102 on the cam arm 90 communicates with the cam wheel 86 to oscillate the cam arm 90 back and forth, the upwardly extending blade 100 communicates with the pin 114 to pivot the upper head portion 112 back and forth. As a result, the mouth of the character figure embodied in the receiver assembly 16 oscillates between a fully open position and a partially open position whenever the timer assembly 14 is in an actuated condition to simulate a chewing action by the character figure. However, when the timer assembly 14 is advanced to the unwound position thereof so that the disengagement lug 60 on the winding arm 32 engages the leg 104 to swing the cam arm 90 outwardly away from the cam wheel 86, the pin 114 is released to allow the upper head portion 110 to pivot downwardly to a position wherein the mouth of the character figure embodied in the receiver assembly 16 is fully closed. In this connection, the receiver assembly 16 is constructed so that the game elements 18 are receivable in the mouth of the character figure when the mouth is in either the open position thereof or the partially open position thereof but so that they are not receivable in the mouth when the mouth is in the closed position.

The game elements 18 preferably comprise substantially spherical balls of relatively lightweight construction to enable them to be effectively propelled by the propelling mechanism 20 and received in the receiver assembly 16.

The propelling mechanism 20 is illustrated most clearly in FIGS. 1 through 3, 7 and 8, and it is pivotably mounted on the post 34 for movement between the operative position illustrated in FIGS. 1 through 3, 7 and 8, and an inoperative position wherein it is received through the notch 33 and disposed beneath the timer assembly 14 in the base 12. As illustrated, when the propelling mechanism 20 is in the operative position thereof, it is disposed substantially in front of the base 12 to enable it to be effectively utilized for propelling the game elements 18 toward the mouth of the character figure embodied in the receiver assembly 16. The propelling mechanism 20 comprises a main body portion 116 which is integrally molded from a suitable plastic material so that it includes a center slot 118, a side storage area 120 for storing the game elements 18, and a side feeder ramp 122 which is inclined downwardly toward the slot 118 so that the game elements 18 naturally roll toward the slot 118. The propelling mechanism 20 further comprises a resilient arm 124 which is slidably mounted in the slot 118 for movement between the retracted position illustrated in FIG. 7 and the extended or operative position illustrated in FIG. 8. The arm 124 and the slot 118 are constructed so that the arm 124 is resiliently depressible when it is in the extended operative position thereof to enable it to be depressed and then released to individually propel the game elements 18 toward the receiver assembly 16. The arm 124 is formed with a guide 126 thereon and an aperture 128 therethrough which cooperate for providing a nest for individually positioning the game elements 18 in a predetermined location on the arm 124 before the arm 124 is released. The propelling mechanism 20 further comprises a slide member 130 which is mounted in the slot 118 so that it engages the arm 124 and so that it is slidable within a preset range along the longitudinal extent of the arm 124. Accordingly, the slide member 130 is adjustably positionable for altering the effective length of the arm 124 in order to adjust the trajectory of the game elements 18 which are propelled by the propelling mechanism 20 so that the game elements 18 can be effectively aimed at the open mouth of the character figure embodied in the receiver assembly 16.

Accordingly, as illustrated in FIGS. 1 and 2, for use and operation of the toy game apparatus 10, the projecting mechanism 20 is pivoted outwardly from beneath the timer assembly 14 to a position wherein it is disposed substantially in front of the base 12, and the resilient arm 124 is moved to the extended or operative position thereof. A plurality of the game elements 18 are then positioned on the ramp 122 so that one of the game elements 18 passes to the nest on the arm 124 as defined by the guide 126 and the aperture 128 but so that the remainder of the game elements 18 are positioned in an aligned row on the ramp 122. Once the game elements 18 have been placed in position in this manner, the winding arm 32 is moved to a wound position and then released so that the mouth of the character figure embodied in the receiver assembly 16 is moved back and forth between the fully open and partially open positions thereof. As soon as the timer assembly 14 has been actuated in this manner, a game player must operate the resilient arm 124 by depressing it and then quickly releasing it to individually propel the game elements 18 toward the mouth of the character figure embodied in the receiver assembly 16 in order to pass the game elements 18 into the mouth of the character figure. In this connection, the slide member 130 can be adjusted in order to properly aim the game elements 18 so that they pass into the mouth of the character figure embodied in the receiver assembly 16. Further, by timing the operation of the propelling mechanism 20 with the movement of the upper head portion 110, the game elements 18 can be propelled toward the mouth of the character figure embodied in the receiver assembly 16 at times when the mouth is in the fully open position thereof so that the mouth provides a larger target for receiving the game elements 18 therein. In the event that some of the game elements 18 miss the mouth of the character figure, they can be retrieved and returned to the ramp 122 as long as the timer assembly 14 is still in an actuated condition. However, as soon as the timer assembly 14 is advanced to the unwound position thereof, the cam arm 90 allows the upper head portion 110 to fall to a fully closed position to prevent further game elements 18 from being received in the receiver assembly 16.

It is seen, therefore, that the instant invention provides an effective and amusing game apparatus. Specifically, the apparatus 10 can be utilized for playing an amusing and interesting game wherein the game elements 18 are individually propelled toward the receiver assembly 16 during set periods of time. In this connection, the skill of game players can be effectively tested as they aim the game elements 18 at the receiver assembly 16 by adjusting the slide member 130 and as they time the operation of the propelling mechanism 20 with the movement of the upper head portion 110. Accordingly the apparatus 10 provides an interesting and amusing game having a high degree of play value, and therefore the instant invention represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An action toy game apparatus comprising a base, a timer on said base actuatable for a set period of time, a plurality of game elements, receiver means on said base communicating with said timer for oscillating said receiver means back and forth between an open position and a partially open position throughout said set period of time, said game elements being receivable in said receiver means in both of said open and said partially open positions thereof, said receiver means moving to a nonreceiving position wherein said game elements are nonreceivable therein upon the expiration of said set period of time, and means for individually propelling game elements towards said receiver means so that they are receivable therein during said set period of time.

2. An action toy game apparatus comprising a base, a timer on said base actuatable for a set period of time, a plurality of game elements, a character figure on said base, said character figure having a mouth, the mouth of said character figure being sufficiently open to individually receive said game elements therein throughout said set period of time but moving to a nonreceiving position wherein it is sufficiently closed to prevent said game elements from being received therein upon the expiration of said set period of time, said propelling means being operable for individually propelling said game elements towards said character figure so that they are receivable in the open mouth thereof during said set period of time, and means for individually propelling game elements towards said character figure so that they are receivable in the mouth thereof during said set period of time.

3. In the action toy game apparatus of claim 2, said character figure comprising a substantially stationary lower jaw portion and an upper head portion, said lower jaw portion and said upper head portion cooperating to define the mouth of said character figure, said upper head portion being rearwardly pivotable for opening said mouth.

4. In the action toy game apparatus of claim 3, said character figure communicating with said timer for oscillating the mouth of said character figure between an open position and a partially open position during said set period of time, said game elements being receivable in the mouth of said character figure in both of said open and said partially open positions thereof.

5. In the action toy game apparatus of claim 3, said character figure further comprising a lever arm, said upper head portion communicating with said timer through said lever arm for pivoting said upper head portion rearwardly to open said mouth.

6. In the action toy game apparatus of claim 5, said timer comprising eccentric means, said lever arm communicating with said eccentric means for pivoting said upper head portion rearwardly.

7. In the action toy game apparatus of claim 6, said timer further comprising a cam arm, said cam arm camming on said eccentric means and communicating with said lever arm for pivoting said upper head portion rearwardly.

8. In the action toy game apparatus of claim 2, said game elements further characterized as substantially spherical ball elements.

9. In the action toy game apparatus of claim 2, said propelling means further characterized as being manually actuatable.

10. In the action toy game apparatus of claim 9, said propelling means comprising a manually depressible resilient arm, said resilient arm being releasable for propelling said game elements toward said receiver means.

11. In the action toy game apparatus of claim 10, said game elements further characterized as spherical ball elements.

12. In the action toy game apparatus of claim 10, said propelling means further characterized as being adjustable to aim said game elements toward said receiver means.

13. An action toy game apparatus comprising a base, a timer on said base actuatable for a set period of time, a plurality of game elements, a character figure on said base, said character figure having a mouth, the mouth of said character figure being sufficiently open to individually receive said game elements therein during at least a portion of said set period of time but moving to a non-receiving position wherein it is sufficiently closed to prevent said game elements from being received therein upon the expiration of said set period of time, said character figure facing toward said propelling means throughout said set period of time, said propelling means being operable for individually propelling said game elements towards said character figure so that they are receivable in the open mouth thereof during said set period of time, and means for individually propelling game elements toward said character figure so that they are receivable in the mouth thereof during said set period of time.

* * * * *